United States Patent [19]

Krob et al.

[11] 4,093,270

[45] June 6, 1978

[54] SAFETY SKI BINDING

[75] Inventors: Erwin Krob, Vienna; Josef Svoboda, Schwechat, both of Austria

[73] Assignee: TMC Corporation, Baar, Zug, Switzerland

[21] Appl. No.: 750,403

[22] Filed: Dec. 14, 1976

[30] Foreign Application Priority Data

Dec. 19, 1975 Austria ..... 9721/75

[51] Int. Cl.[2] ..... A63C 9/08

[52] U.S. Cl. ..... 280/626; 36/120

[58] Field of Search ..... 280/626, 631, 632; 36/120

[56] References Cited

U.S. PATENT DOCUMENTS

| | | | |
|---|---|---|---|
| 3,521,385 | 7/1970 | Dalebout | 36/120 |
| 3,580,597 | 5/1968 | Beyl | 280/632 |
| 3,686,778 | 8/1972 | Hornung | 36/120 |
| 3,787,062 | 1/1974 | Kuseanovich | 280/632 |

FOREIGN PATENT DOCUMENTS

| | | | |
|---|---|---|---|
| 2,404,233 | 4/1975 | Germany | 36/120 |

*Primary Examiner*—Robert R. Song
*Attorney, Agent, or Firm*—Blanchard, Flynn, Thiel, Boutell & Tanis

[57] ABSTRACT

A safety ski binding having a reinforcing member on a ski boot, which ski boot has a shaft portion which is pivotal about a transverse axis. The reinforcing member has a shoulder thereon which is engageable with a removable support to limit the backward pivoting movement of the shaft portion but permit a desired amount of frontward movement. A lever is provided which is movable into and out of supporting engagement with the shoulder to facilitate entry of the ski boot into the ski binding.

15 Claims, 13 Drawing Figures

SAFETY SKI BINDING

FIELD OF THE INVENTION

The invention relates to a safety ski binding having a reinforcing member for the ski boot which is pivotal about a transverse axis on the ski boot and has in the area of the boot shaft at least one stiff side portion which rests on the ski boot and effects a holding or support of the shaft of the ski boot.

BACKGROUND OF THE INVENTION

Such a safety ski binding is described for example in Swiss Pat. No. 505 630. However, in the known construction the safety ski binding is arranged with a release plate which is connected to the ski boot and is held releasably on the ski, wherein the reinforcing member is hinged to the release plate or to the heel of the ski boot. This known solution will give the joint of the foot a lateral support and a freedom of maneuver in the joint of the foot is possible in the longitudinal direction of the ski.

However, more recently gained knowledge has shown that different requirements must be met between the boot shaft and the reinforcing member during downhill skiing and during walking. Furthermore, it was discovered that the forward position of the ski boot shaft for one and the same skier varies slightly between certain limits depending on the local manner of skiing, however, the rear support requires a clear definition.

The purpose of the invention is now to attain also this purpose in a safety ski binding of the abovementioned type. This is achieved according to the invention by the reinforcing member having a shoulder, extension or the like, which is loaded by a binding part and forms a removable support.

The set purpose is perfectly attained by the inventive safety ski binding. Due to the fact that the binding part is constructed as a removable support, it can form the predetermined hold for the backwardmost position of the shaft of the ski boot and the degree of the forward position necessary between pregiven limits can be determined freely by the designer.

The shoulder, extension or the like can be mounted on a metal fitting or can be formed as a part thereof wherein the metal fitting rests advantageously formlockingly on or against the reinforcing member on the ski boot. This measure permits the design of the heel independent of the design of the boot shaft. The metal fitting may also be secured, preferably riveted to the reinforcing member. In this case the relationship between the position of the reinforcing member and the metal fitting to the ski binding is constant.

A different thought of the invention is seen in the shoulder, extension or the like being arranged on a bar or as part of same wherein the bar is hinged to the transverse axis of the reinforcing member. This design has the advantage that an already existing holding mechansim (the transverse axis) can be used simultaneously for holding the bar. In a further development of this thought of the invention the relative position between the bar and the reinforcing member can be designed adjustably.

It is furthermore possible to design the mounting between the reinforcing member and the metal fitting or bar to be elastic. The elastic material which is hereby used can be formed as a base of rubber or plastic, however, may also be, also inventively, an intermediate layer, the physical characteristics of which give the entire system a dampening which acts against the outside forces.

An important thought of the invention lies in a spring being provided in the binding part and a lock active against said spring wherein the spring, after a releasing of the lock, holds the binding part in relationship to the shoulder, extension or the like in the ready position and with a predetermined forward position for the reinforcing member which becomes limited in a rearwardly supported position. This measure assures that the binding part is always ready for downhill skiing after an arbitrarily occurred freeing of the reinforcing member when the skier effects a snapping in of the binding part with an intentional forward positioning at the shaft of the ski boot.

The binding part itself can be supported inventively pivotally about an axis or movably in the support plane. Depending on the position of the axis or the guideway the arrangement and design of the spring must be carried out.

BRIEF DESCRIPTION OF THE DRAWINGS

Further advantages and details of the invention will be described more in detail with reference being made to the drawings, which illustrate several exemplary embodiments.

In the drawings.

DETAILED DESCRIPTION

Figure 1:
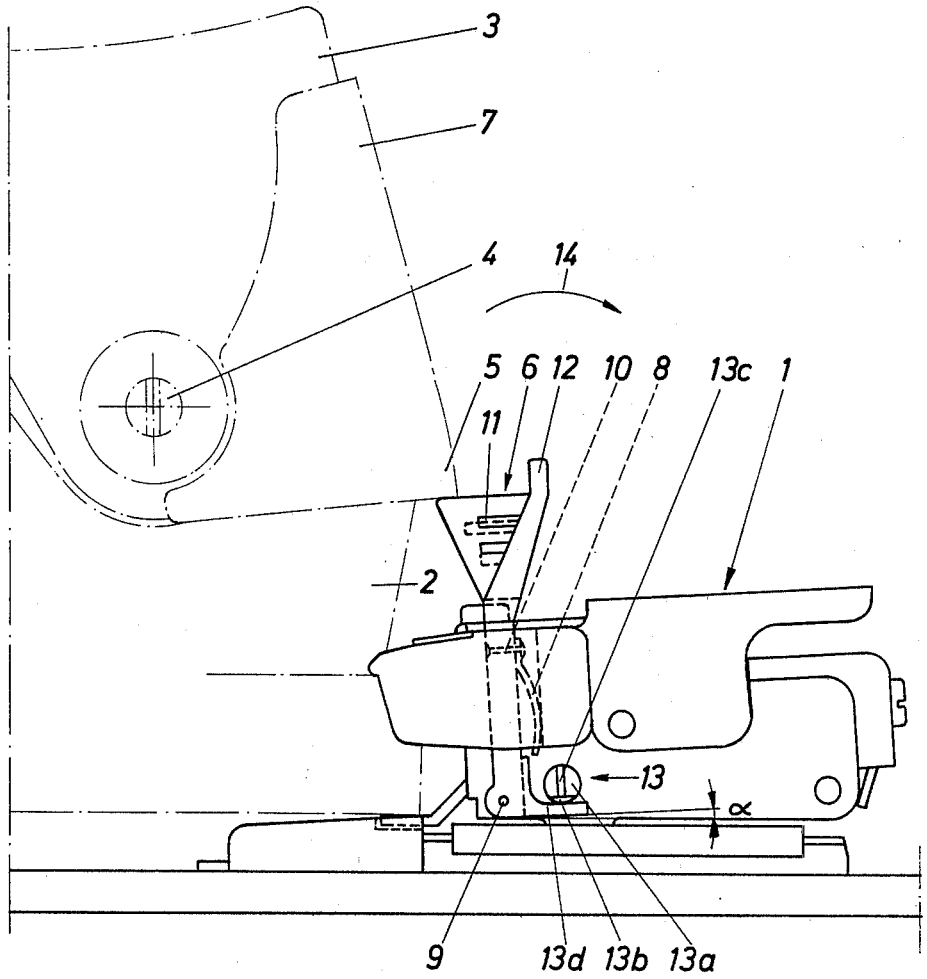
FIGS. 1 and 2 are a side view and a top view, respectively, of the inventive safety ski binding, wherein in FIG. 1 parts of the cooperating ski boot are also shown.
Figure 2:
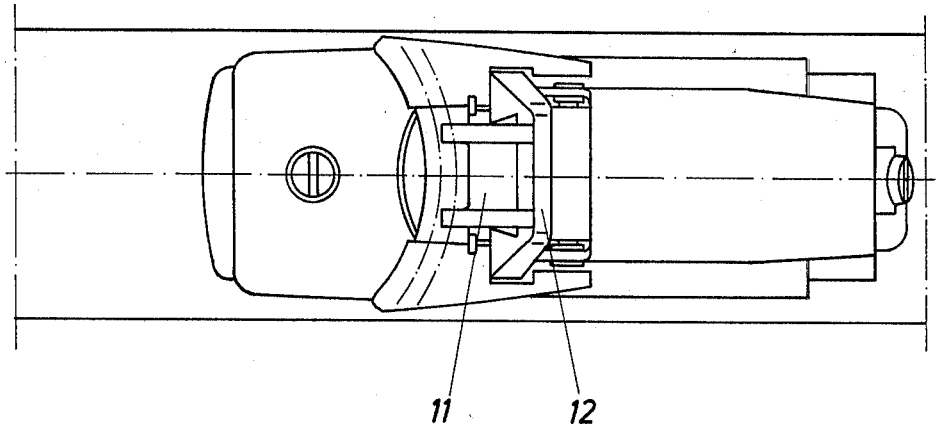
Figure 3:
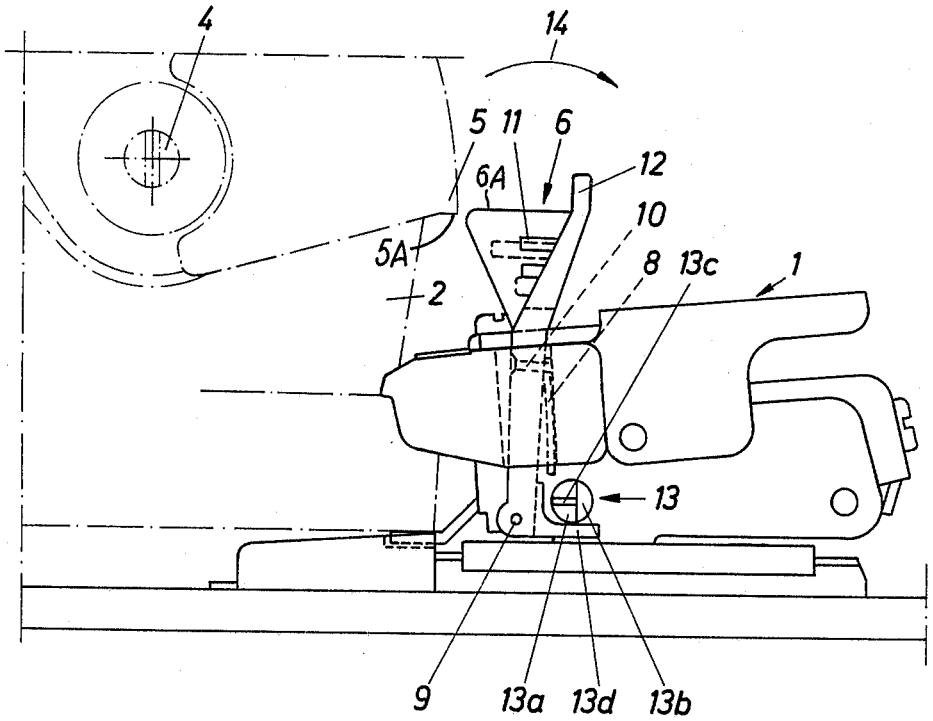
FIG. 3 illustrates the ski binding part according to FIG. 1 in open position.

As illustrated in FIGS. 1 to 3, the inventive safety ski binding 1 is operatively connected to cooperate with a ski boot 2, on which a reinforcing member or ankle cuff 3 is hingedly secured for movement about a transverse axis 4 on the ski boot, by means of a binding part 6 which cooperates with a shoulder, extension 5 or the like on a metal fitting 7 secured also to the heel of the ski boot 2. Remaining parts of the ski boot which are not part of the invention are of a conventional construction and will be familiar to the man skilled in the art. Therefore, further discussion of these parts appears to be unnecessary.

The binding part 6 is loaded by a spring 8, which in the present exemplary embodiment is a leaf spring. The binding part 6 is pivotally supported for movement about the axis of a pin 9 which extends transversely with respect to the longitudinal axis of the ski. The leaf spring 8 is secured by means of a rivet 10 to the binding part 6 and engages a fixed part of the safety ski binding 1. As a result, the binding part 6 constantly under spring force. Since the binding part 6 is urged by a substantially vertically directed force applied thereto by the shoulder, extension 5 or the like, a relatively weak spring 8 is sufficient to hold the binding part 6 constantly in the engaged position with the shoulder 5. The spring force also makes it possible to push the binding part 6 away from the shoulder 5. The binding part 6 has a support member 11 onto which the point of a ski pole can be placed. Furthermore, the binding part 6 has a lever arm 12 which permits a manual operation or pivoting of the binding part 6 about the axis 9. If now the binding part 6 is swung rearwardly in direction of the arrow 14 in FIG. 1 either by means of the ski pole or manually against the force of the leaf spring 8, then the lower edge 5A of the shoulder, extension 5 or the like is rendered free of engagement with the upper edge 6A of the binding part 6 so that the reinforcing member 3 with the metal fitting 7 thereon can be pivoted backwardly about the transverse axis 4. This position is shown in FIG. 3. It will be easily recognized that the binding part 6 remains disengaged from the shoulder, extension 5 or the like as long as the lower edge 5A thereof is below the upper edge 6A of the binding part 6. Therefore, the reinforcing member 3 or the metal fitting 7 secured thereto are freely swivelable or pivotal in this area.

If the skier again intends a blocking of the shaft of the ski boot to limit the rearward movement thereof, then he pivots the reinforcing member 3 and thus the metal fitting 7 with the shoulder, extension 5 or the like, on the ski boot 2 forwardly so that the lower edge of the shoulder 5A is raised above the upper surface 6A on the binding part 6 loaded by the leaf spring 8. In order to be able to carry out the stepping-in operation automatically, that is to freely insert the ski boot 2 into the binding, a lock 13 is provided. If the binding part 6 is swung backwardly to an angle where the lock 13 becomes active, the binding part 6 remains in the retracted position independent of the position of the reinforcing member 3 during the opened position. If, however, the lock 13 is freed, then the spring loading of the leaf spring 8 on the binding part 6 becomes active so that during a forward position thereof as above described, the ski boot blocking action occurs. A comparison of FIGS. 1 and 3 will make an understanding of the two positions more apparent.

According to the present embodiment, the lock 13 is constructed in the form of an eccentric **13*a* which is operatively connected to an extension member 13*d* mounted on the lever arm 12. The eccentric 13*a* is formed similar to a rotary knob which has a flat part 13*b* thereon extending along a chord. Furthermore the eccentric 13*a* has a slot 13*c*** into which a suitable means, for example a coin, can be inserted.

The lock 13 is operated as follows. If the flat part **13*b* of the eccentric 13*a* engages the extension member 13*d* of the lever arm 12 as shown in FIG. 1, then the lever arm 12 can be pivoted about the axis 9 between limits which are defined on one side by the flat part 13*b* and on the other side by a surface of the binding support which is not identified in any detail. The limits between which the extension member 13*d* is movable is identified by the angle $\alpha$ in FIG. 1**.

FIG. 3 shows, as stated above, the binding part 6 pivoted in the direction of the arrow 14, manually by means of the lever arm 12 into the position indicated in FIG. 1 with the eccentric **13*a* having been rotated 90° from the position illustrated in FIG. 1. Therefore, the eccentric is here positioned with the full circle part engaging the extension member 13*d* of the lever arm 12 so that the binding part 6 is fixed in its swung-out or swung-back position. To re-engage the binding part 6 with the shoulder 5 on the ski boot 2, the eccentric 13*a* is rotated in the opposite direction 90° which causes the binding part 6 to be freely pivotal under the urging of the spring 8** within the limits defined by the angle $\alpha$.

Figure 4:
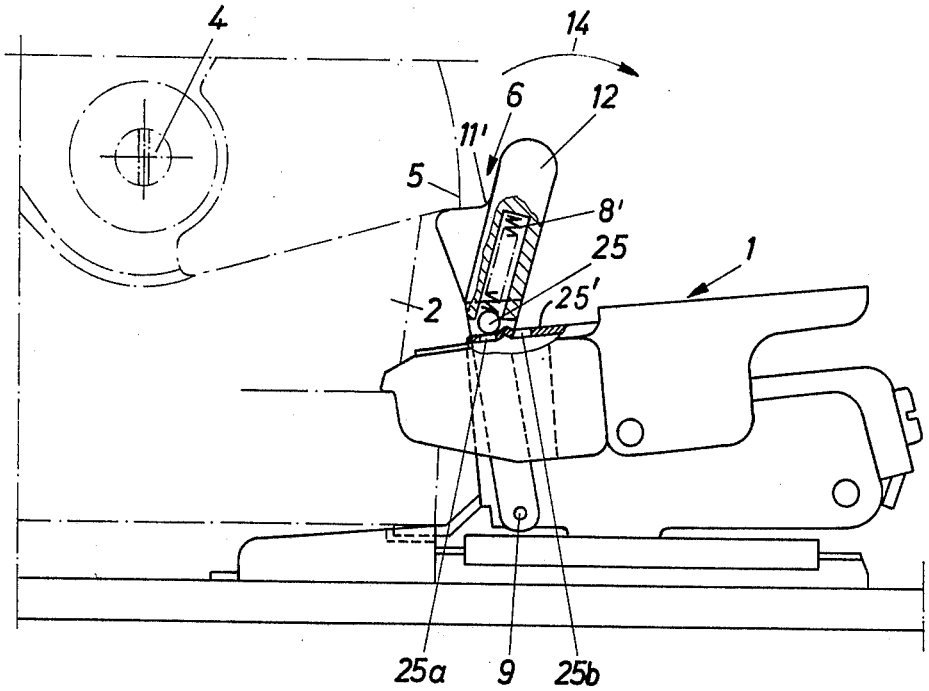
FIG. 4 illustrates a detail of a spring which loads a locking ball.

In the exemplary embodiment according to FIG. 4, the spring is designed as a pressure or coil spring 8' which, in this embodiment, is arranged in the lever arm 12 and loads a ball 25 which is receivable in one of two locking recesses **25*a* or 25*b*. In the position shown in FIG. 4, the lever arm 12 is in engaging position with the shoulder 5 on the ski boot 2 and the ball 25 is received in the frontmost locking recess 25*a*. If the lever 12 becomes disengaged from the shoulder 5 on the ski boot 2, then the ball 25 slides along the inner inclined surface of the locking plate 25' against the force of the spring 8' until it has reached the apex between the locking recesses 25*a* and 25*b* and slides subsequently due to the action of the spring 8' into the rear locking recess 25*b*. In this case, a similar freeing or unblocking of the here not shown reinforcing member 3 is achieved as was described above with reference to the embodiment of FIGS. 1 to 3**. Further details should also be able to be taken from the preceding example.

Figure 5A:
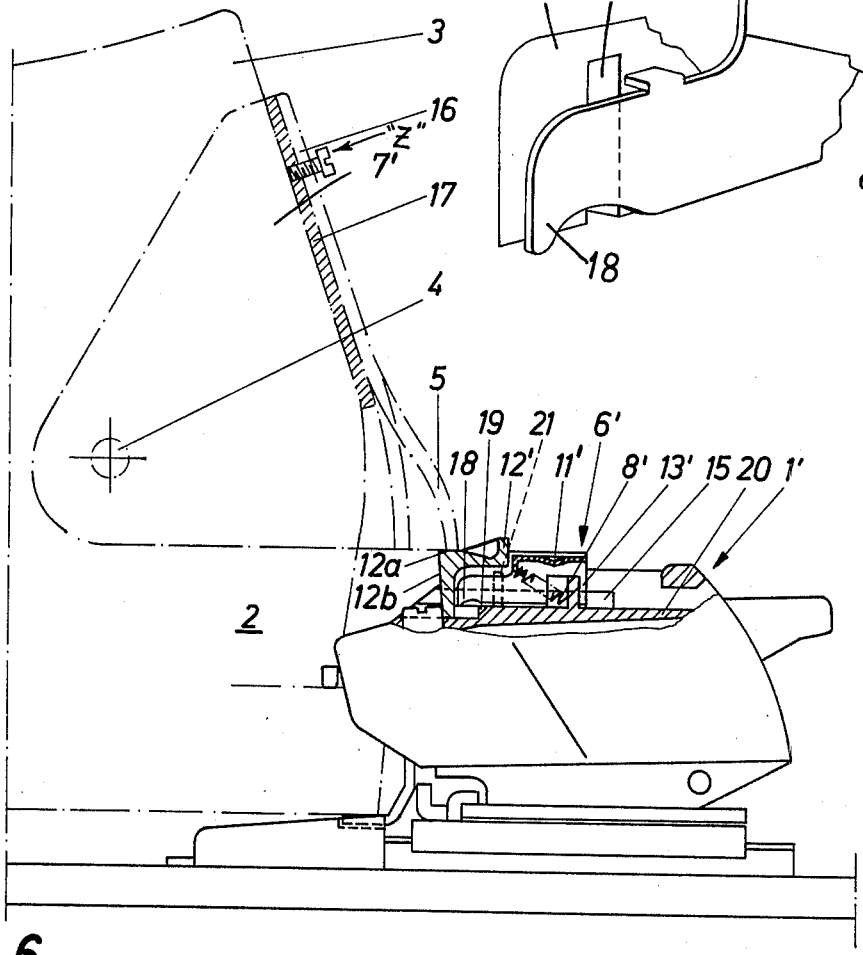
FIGS. 5A and 6 illustrate a second exemplary embodiment similar to the side view and the top view, respectively, of FIGS. 1 and 2.
Figure 5B:
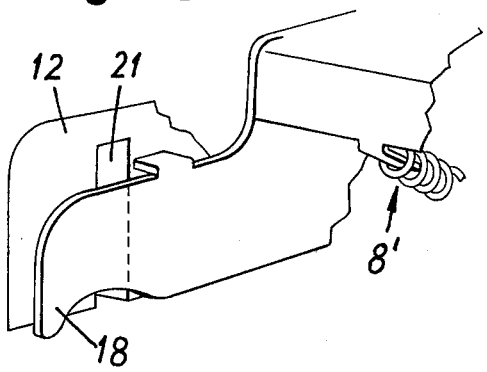
FIG. 5B is a fragmentary perspective view of illustration the securement between the locking noses and the holder.
Figure 6:
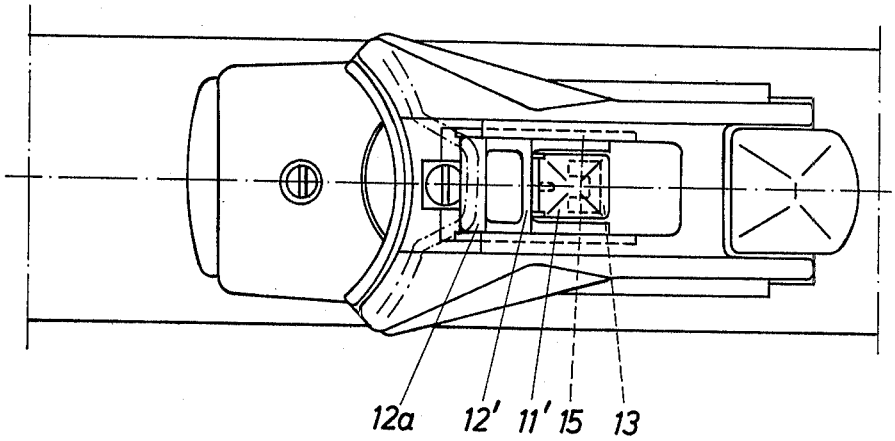
Figure 7:
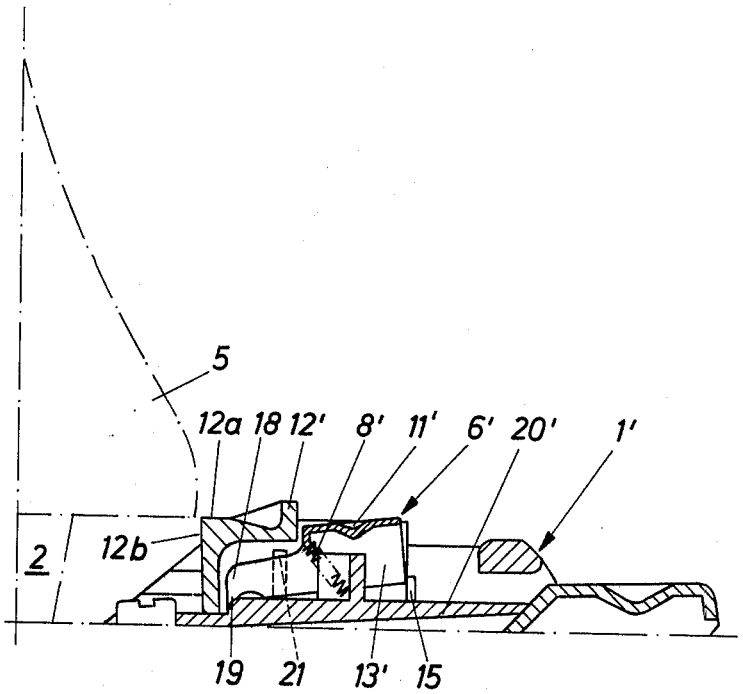
FIG. 7 illustrates the open position of the ski binding part according to FIG. 5.

The exemplary embodiment according to FIGS. 5 to 7 illustrates a different safety ski binding 1' having a different binding part 6' which cooperates with a modified metal fitting 7' on the ski boot. The binding part 6' is, according to this exemplary embodiment, reciprocally movably supported on a sliding plane or surface 20. Here too a support member 11' for engagement with the ski pole and a lever arm or slide 12' for manual operation of the binding part 6' are provided. The spring is designed as a pressure or coil spring 8'. A guideway 15 is used as guiding support for the binding part 6'.

According to the present exemplary embodiment, the binding part 6' has in the part which serves as a lock 13' two laterally spaced locking noses 18 which are movable to engage locking surfaces 19. As is shown in FIG. 5, the locking noses 18 are closely adjacent the position where the binding part 6' engages the shoulder 5 against the urging of the pressure or coil spring 8' and above the sliding surface 20 on the safety ski binding 1', which sliding surface is determined in part by the guideway 15.

FIG. 5A also shows an embodiment wherein the shoulder 5 is constructed as a part of an elongated bar 16 wherein the bar 16 is secured to the metal fitting 7 which is hingedly connected to the transverse axis 4 of the reinforcing member 3. It is also possible to arrange the shoulder 5 separately on the bar 16. The relative position between the bar 16 and the reinforcing member 3 is adjustable. From this figure it can also be recognized that between the bar 16 and the reinforcing member 3 there is provided a support member 17 made of elastic material, for example rubber or plastic, preferably foam rubber. The support member 17 serves as an intermediate layer which can, due to the present physical characteristics, in particular due to its strength and elasticity, lend the entire system to a dampening action against outside forces.

The lock 13' is tiltably supported on a holder 21 so that after an adjustment of the lock 13' to effect a disengagement between the binding part 6' and the shoulder 5, same is tilted under the urging of the pressure spring 8' into the position shown in FIG. 7 wherein the locking noses 18 engage the locking surfaces 19. As can be taken from FIG. 7, a free movement of the reinforcing member is then assured. If the skier applies with a not illustrated ski pole a force onto the recess portion 11' of the support member 11 which is provided in the lock 13', the lock 13' will be pivoted against the force of the pressure spring 8' about the holder 21 in a clockwise direction, whereby the component of the spring (pressure spring) 8', which component acts in an axial direction, moves the lock 13' forwardly. If during the aforesaid movement, the shoulder 5 is lifted high enough that the support part **12*a* of the lever arm 12' can move under the shoulder 5, then the position shown in FIG. 5 is attained. If, however, the lower edge of the shoulder 5 restricts the entire path of movement of the binding part 6', then the front side 12*b* of the lever arm 12' engages the outside of the shoulder 5 to cause the lock 13' to be ready to snap in upon a lifting of the shoulder 5**. This means that in the case of a predetermined forward position of the shaft of the ski boot, the ski boot blocking function is now carried out automatically.

Figure 8:
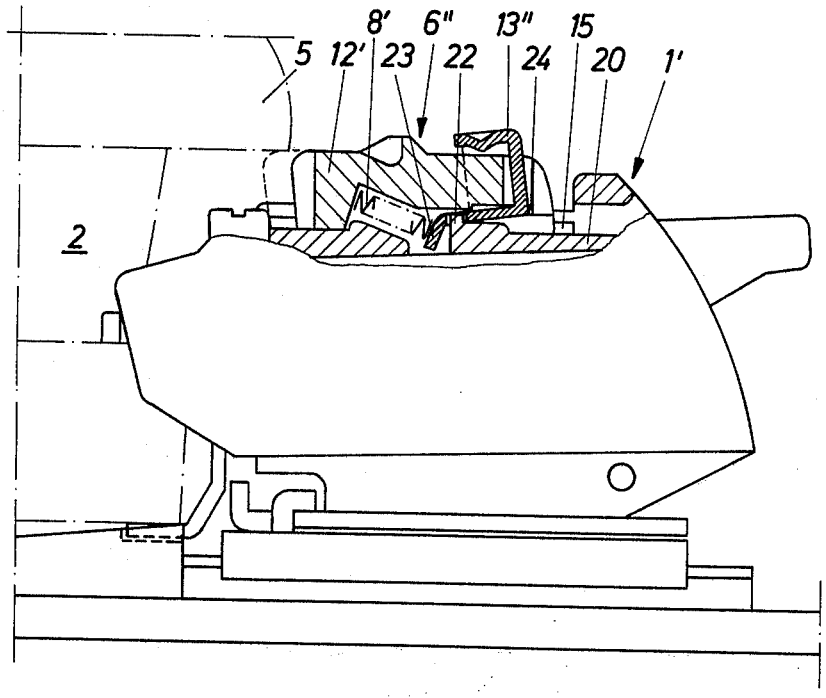
FIGS. 8 to 12 illustrate further modifications of the ski binding part according to the exemplary embodiment in FIGS. 5 to 7.

In the exemplary embodiment shown in FIG. 8, the binding part 6'' is modified so that the lock 13'' is locally fixed against axial movement but is supported for tilting movement about a horizontal axis 22. The lock 13'' has a forwardly projecting support member 23 on which one end of a torsion spring 8' is supported. The lock 13'' is provided with a notch 24 adjacent its rear area for, in the position shown in full lines in FIG. 8, engaging the longitudinally movably designed lever arm 12''. FIG. 8 also shows in dash-dotted lines the position of the binding part 6'' when the lock 13'' is disengaged from the locked retracted position and the pressure spring 8' brings the lever arm 12'' into engagement with the shoulder 5 on the ski boot 2. The position of this lock 13'' is not illustrated in any more detail for the purpose of better clarity.

Figure 9:
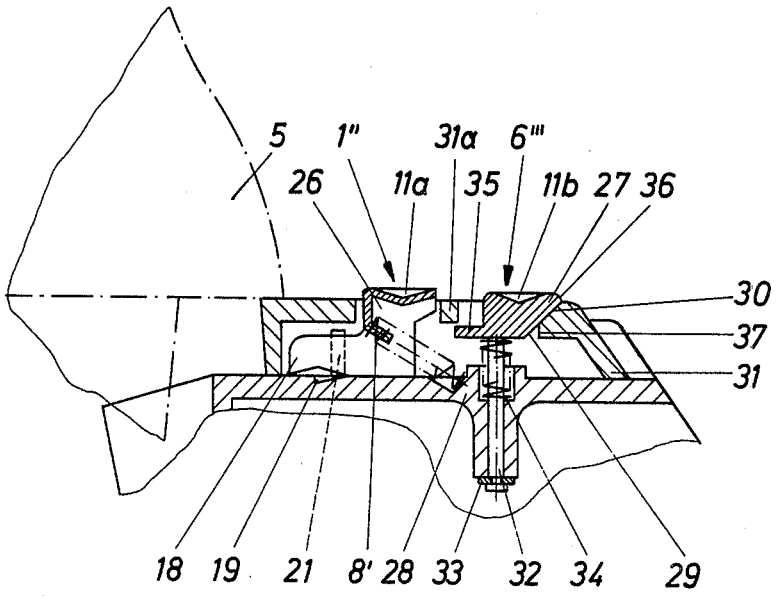
Figure 10:
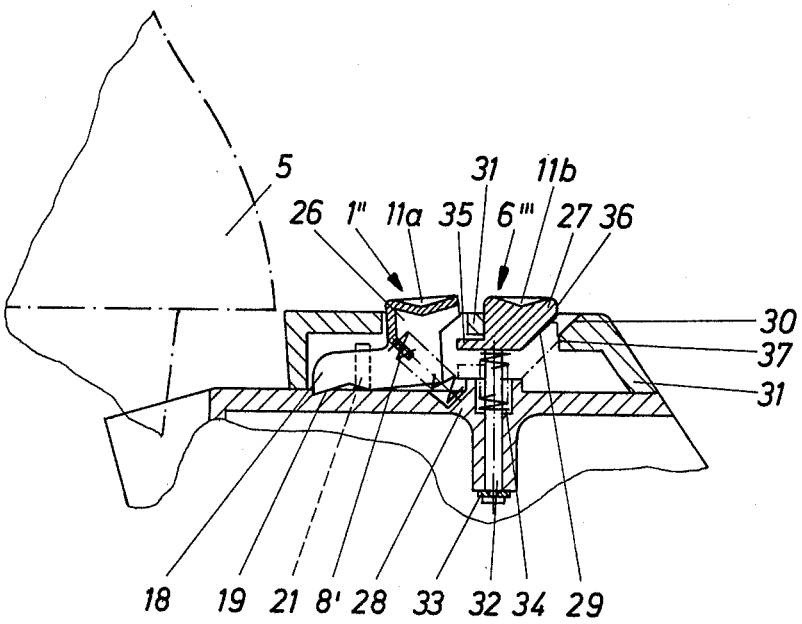

The exemplary embodiment according to FIGS. 9 and 10 shows a different construction of the binding part. For this reason new reference numerals are also utilized for the main parts. The presently existing reference numerals will be used for the unchanged parts.

A tilting part 26 and a closing part 27 are illustrated in FIGS. 9 and 10. Both the tilting part 26 and also the closing part 27 have support members **11*a*, 11*b* thereon to receive the tip of a ski pole. The tilting part 26 is loaded by a pressure spring 8' which engages a fixed ski binding part 6'''. The tilting part 26 has locking noses 18 thereon which, as described above, engage locking point surfaces 19. To carry out the tilting function, the holder 21** is provided.

The closing part 27 has a sloped surface 29 on the rearward side thereof which cooperates with an identically sloped surface 30 on the frame 31 of the tilting part 26. The closing part 27 has a downwardly extending locking bolt 31 reciprocally mounted in a vertically aligned hole in the binding 1''. The bolt 32 is secured at the lower free end by means of a nut-like member 33 the locking bolt 32 is encircled in the upper area between the binding frame structure and the closing part 27 by a spring 34. The spring 34 biases the closing part 27 from below and urges same constantly upwardly. The closing part 27 has on its front side which is opposite to the sloped surface 29 a flange 35 which cooperates with the frame part **31*a* on the tilting part 26**.

If a substantially vertically downwardly acting force is applied onto the support member **11*b* of the closing part 27 with the tip end of the ski pole, then the sloped surface 29 of the closing part 27 slides downwardly on the sloped surface 30 of the tilting part 26 and on its frame part 31. Through this the tilting part 26 is moved from the position shown in FIG. 9 away from engagement with the shoulder 5 until the rear, vertical wall 36 of the closing part 27 comes to rest on the front vertical wall 37 of the frame. This position of the closing part 27 is shown in dash-dotted lines with respect to the closing part 27 in FIG. 10. Since in this position the frame 31 is pushed rearwardly so that the locking noses 18 can engage the locking surfaces 19, the binding part 6''' is fixedly held in the mentioned position wherein the ski boot shaft (not shown) can be freely pivoted within the pregiven limits. FIG. 10 also shows the closing part 27 in solid lines in the position where the force of the ski pole has been terminated and due to the action of the spring 34 the closing part 27 has again returned into the upper position. The tilting part 26** is in the tilted position.

Thereafter, if a force is applied with the tip end of the ski pole onto the support **11*a* of the tilting part 26, the binding part 6''' will move under the urging of the spring 8' into the ready position or — in case the shoulder 5** has been swung forwardly to a sufficient degree — into the support position.

Figure 11:
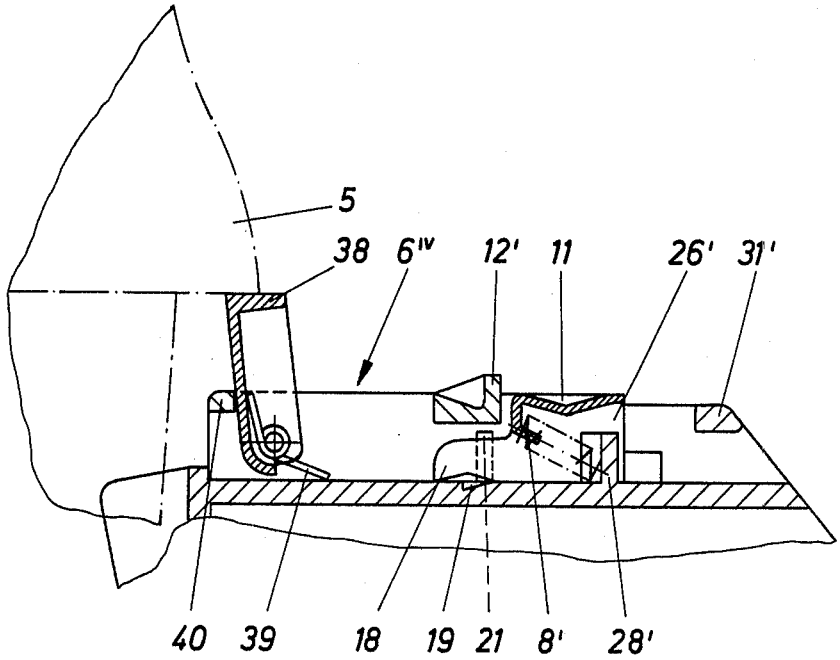
Figure 12:
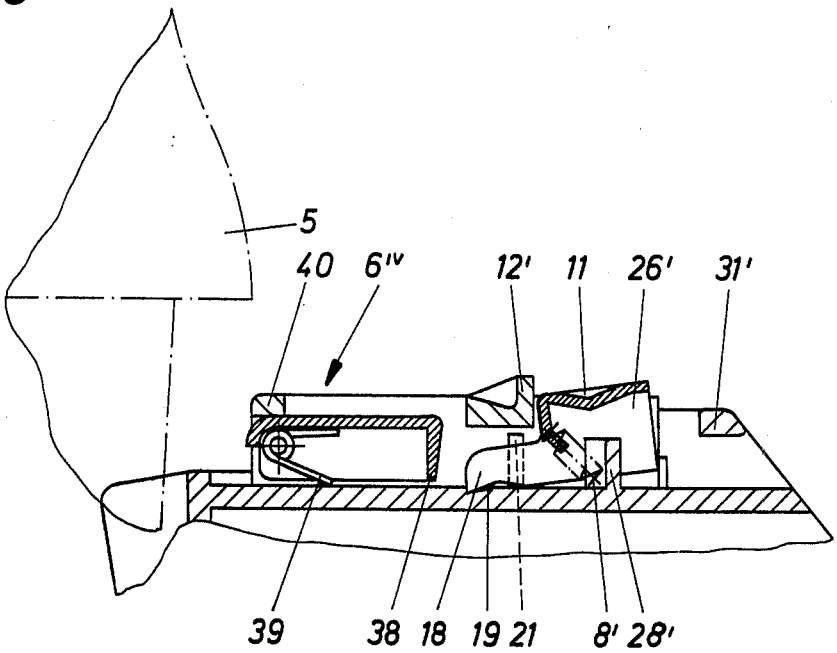

In the embodiment according to FIGS. 11 and 12, the binding part 6^IV^ is designed to have a specially low structure. The part 26' which is here provided is similar to the part 26 in the embodiment according to FIGS. 9 and 10 — except that the part 26' is shifted rearwardly in longitudinal direction of the ski. A support element 38 is provided adjacent the front area of the binding part 6^IV^ and is loaded by a torsion spring 39 which constantly urges the support element 38 into the opening position to cause same to come into engagement with the shoulder 5. The tilting part 26' with the support member 11 or a lever arm 12' are used to move the binding part 6^IV^ rearwardly. The frame 31' is here provided with a support nose 40 which engages the support element 38 and moves the support element 38 out of engagement from the shoulder 5 during movement of the frame 31' rearward against the force of the torsion spring 39. This retracted position is shown in FIG. 12. The tilting part 26' locks with the locking noses 18 into the locking surfaces 19 as has already been described in the preceding examples. In this case, one end of the pressure or coil spring 8' engages a fixed ski binding part 28'. The further manner of operation should result from the already described operations.

The invention is not limited to the listed exemplary embodiments. Further modifications are possible without departing from the scope of the invention. For example, different locking or closing devices can be combined with one another and the safety ski bindings which are used thereby may also differ from the listed examples. It is also conceivable to permit the pivotal binding part to disengage transversely with respect to the longitudinal axis of the ski or also to adjust the binding part at an angle with the sliding movement in the longitudinal direction of the ski. A two-sided support may thereby take place wherein the release can occur for example not only along a straight line but also along a curved line, preferably along an arc. Also the springs which are used can be designed differently or can be exchanged with one another. There exists also the possibility to replace a spring or also, if existent, both springs with a different elastic element, for example with a rubber spring or a mini hydraulic spring. Also the operating elements for operation by the ski pole and/or by the hand can be designed differently. For example, the parts which are to be operated may have an eyelet or a hook which permit a connection to a safety strap wherein the user must pull on a separate part of the safety strap to effect an operation of the device.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a combination of a ski boot and a ski binding, said ski boot having a lower shell and an ankle cuff pivotally secured to said lower shell to allow pivotal movement of said ankle cuff about a pivot axis in response to shifts in the weight of an individual using said ski boot, said ski binding including at least a heel holder engaging the heel portion of said ski boot to hold said heel portion to a ski, the improvement comprising wherein said ankle cuff has projection means extending rearwardly therefrom and includes first means thereon defining a downwardly facing first surface and wherein said heel holder includes second means defining an upwardly facing second surface, said first surface directly engaging said second surface to limit the amount of pivotal movement of said ankle cuff to the rear of said lower shell, support means for supporting said second means for movement toward and away from said heel portion of said ski boot and resilient means for resiliently urging said second means toward said ski boot.

2. The improved combination according to claim 1, wherein said projection means includes a metal fitting mounted on said ankle cuff and movable therewith and wherein said metal fitting has said first surface thereon.

3. The improved combination according to claim 2, wherein said metal fitting is fixedly secured to said ankle cuff.

4. The improved combination according to claim 1, wherein said second means includes a bar and wherein said support means includes a hinged joint with an axis extending laterally of said ski for supporting said bar for pivotal movement.

5. The improved combination according to claim 4, wherein said projection means includes adjusting means for adjusting the position of said first surface relative to said ankle cuff.

6. The improved combination according to claim 5, wherein said projection means includes a support member made of elastic material.

7. The improved combination according to claim 6, wherein said support member is an intermediate layer, the physical characteristics of which, in particular its strength and elasticity, lend to the entire system a dampening which acts against the outer forces.

8. The improved combination according to claim 1 wherein said locking means includes a lock member and a spring, said lock member being movable against said spring, wherein said spring after release of said lock member holds said second means with respect to said projection means in the ready position spaced away from said ski boot and said projection means.

9. The improved combination according to claim 1, wherein said support means pivotally supports said second means for movement about an axis.

10. The improved combination according to claim 1, wherein said support means supports said second means for horizontal movement.

11. The improved combination according to claim 9, wherein said pivot axis lies at a distance behind the point of engagement on said first and second surfaces, which point of engagement effects a pulling in of said second means into a position adjacent said ski boot and said projection means.

12. The improved combination according to claim 8, wherein said second means includes a lever arm and wherein said lock member is an eccentric which cooperates with a shoulder on said lever arm.

13. The improved combination according to claim 8, wherein said lock member is a springloaded ball which is in engagement with a part of a recess in said heel holder.

14. The improved combination according to claim 8, wherein said lock member has at least one locking axis defining part thereon which can be brought into engagement with a locking surface on said heel holder.

15. The improved combination according to claim 1, including locking means for locking said second means in a position spaced away from said ski boot.

* * * * *